US011959468B2

(12) United States Patent
Petzold et al.

(10) Patent No.: US 11,959,468 B2
(45) Date of Patent: Apr. 16, 2024

(54) APPARATUS FOR CONVEYING THICK MATTER

(71) Applicant: Putzmeister Engineering GmbH, Aichtal (DE)

(72) Inventors: Wolf-Michael Petzold, Aichwald (DE); Jan-Martin Veit, Pliezhausen (DE); Michael Schaefer, Gaeufelden-Tailfingen (DE); Frederik Kort, Stuttgart (DE)

(73) Assignee: Putzmeister Engineering GmbH, Aichtal (DE)

( * ) Notice: Subject to any disclaimer, the term of this patent is extended or adjusted under 35 U.S.C. 154(b) by 25 days.

(21) Appl. No.: 17/058,276

(22) PCT Filed: May 20, 2019

(86) PCT No.: PCT/EP2019/063211
§ 371 (c)(1),
(2) Date: Nov. 24, 2020

(87) PCT Pub. No.: WO2019/224244
PCT Pub. Date: Nov. 28, 2019

(65) Prior Publication Data

US 2021/0239103 A1 Aug. 5, 2021

(30) Foreign Application Priority Data

May 25, 2018 (DE) ..... 10 2018 208 263.4

(51) Int. Cl.
*F04B 15/02* (2006.01)
*F04B 1/02* (2006.01)
(Continued)

(52) U.S. Cl.
CPC ..... *F04B 15/02* (2013.01); *F04B 1/02* (2013.01); *F04B 9/103* (2013.01); *F04B 17/06* (2013.01);
(Continued)

(58) Field of Classification Search
CPC ..... F04B 1/02; F04B 1/04; F04B 9/08; F04B 9/10; F04B 9/103; F04B 9/109;
(Continued)

(56) References Cited

U.S. PATENT DOCUMENTS 6,929,454 B2 8/2005 Muenzenmaier et al.
7,322,802 B2 1/2008 Benckert et al.
(Continued)

FOREIGN PATENT DOCUMENTS

CN 101614228 A * 12/2009 ..... F15B 11/16
CN 203548410 U * 4/2014 ..... F15B 15/14
(Continued)

OTHER PUBLICATIONS

International Search Report (PCT/ISA/210) issued in PCT Application No. PCT/EP2019/063211 dated Aug. 9, 2019 with English translation (five (5) pages).
(Continued)

*Primary Examiner* — Essama Omgba
*Assistant Examiner* — Chirag Jariwala
(74) *Attorney, Agent, or Firm* — Crowell & Moring LLP

(57) ABSTRACT

An apparatus for conveying thick matter has a drive cylinder for receiving hydraulic fluid, a drive piston, which is arranged in the drive cylinder, a conveying cylinder for receiving thick matter, a conveying piston, which is arranged in the conveying cylinder, and a piston rod, which is fastened to the drive piston for coupling motion together with the conveying piston. The drive cylinder has a rod-side opening for applying pressure to a rod side of the drive
(Continued)

piston by way of hydraulic fluid and a crown-side opening for applying pressure to a crown side of the drive piston facing away from the rod side by the hydraulic fluid. A drive pump is designed to generate a drive volume flow having a drive pressure of hydraulic fluid for moving the drive piston. A pump connection is designed for variable connection of the drive pump to the rod-side opening or the crown-side opening for the flow of hydraulic fluid. A sensor is designed for automatic detection of whether the pump connection is connected to the rod-side opening or the crown-side opening. A control unit controls the apparatus in a rod-side operating mode, when the rod-side pump connection is detected, and in a crown-side operating mode, when the crown-side pump connection is detected.

9 Claims, 7 Drawing Sheets

(51) Int. Cl.

| | |
|---|---|
| ***F04B 9/103*** | (2006.01) |
| ***F04B 17/06*** | (2006.01) |
| ***F04B 49/00*** | (2006.01) |
| ***F04B 51/00*** | (2006.01) |
| ***F04B 53/14*** | (2006.01) |

(52) U.S. Cl.
CPC ..... *F04B 49/002* (2013.01); *F04B 49/005* (2013.01); *F04B 51/00* (2013.01); *F04B 53/144* (2013.01)

(58) Field of Classification Search
CPC ..... F04B 9/111; F04B 15/02; F04B 17/06; F04B 23/00; F04B 23/02; F04B 23/025; F04B 23/04; F04B 23/06; F04B 49/002; F04B 49/005; F04B 51/00; F04B 53/144; F04B 49/00; F04B 49/18
See application file for complete search history.

(56) References Cited

U.S. PATENT DOCUMENTS

| | | | | |
|---|---|---|---|---|
| 7,611,332 | B2 | 11/2009 | Hofmann et al. | |
| 2003/0170127 | A1* | 9/2003 | Muenzenmaier ..... | F04B 9/1178 417/342 |
| 2006/0153700 | A1* | 7/2006 | Benckert ..... | F04B 15/02 417/338 |
| 2006/0245943 | A1* | 11/2006 | Hofmann ..... | F04B 15/02 417/399 |
| 2015/0096290 | A1* | 4/2015 | Veit ..... | F15B 7/006 60/421 |
| 2018/0045186 | A1 | 2/2018 | Koch et al. | |

FOREIGN PATENT DOCUMENTS

| | | | | |
|---|---|---|---|---|
| DE | 34 48 016 | A1 | 6/1986 | |
| DE | 38 34 678 | A1 | 4/1990 | |
| DE | 100 36 202 | A1 | 2/2002 | |
| DE | 100 38 647 | A1 | 2/2002 | |
| DE | 101 50 467 | A1 | 4/2003 | |
| DE | 10 2012 211 367 | A1 | 1/2014 | |
| DE | 10 2013 104 494 | A1 | 11/2014 | |
| DE | 10 2015 103 180 | A1 | 9/2016 | |
| JP | 59-206683 | A | 11/1984 | |
| WO | WO 2005/093253 | A1 | 10/2005 | |
| WO | WO-2014001020 | A1 * | 1/2014 | ..... F04B 15/02 |

OTHER PUBLICATIONS

German-language Written Opinion (PCT/ISA/237) issued in PCT Application No. PCT/EP2019/063211 dated Aug. 9, 2019 (six (6) pages).

* cited by examiner

APPARATUS FOR CONVEYING THICK MATTER

FIELD OF USE AND PRIOR ART

The invention relates to an apparatus for conveying thick matter.

PROBLEM AND SOLUTION

The invention is based on the problem of providing an apparatus for conveying thick matter which permits an optimum and/or reliable conveying action.

The invention solves this problem through the provision of an apparatus for conveying thick matter having the features of the independent claim. Advantageous refinements and/or configurations of the invention are described in the dependent claims.

The apparatus according to the invention for conveying thick matter has at least one drive cylinder, at least one drive piston, at least one conveying cylinder, at least one conveying piston and at least one piston rod. The drive cylinder is designed to receive hydraulic liquid, in particular oil. The drive piston is arranged in the drive cylinder. The conveying cylinder is designed to receive thick matter. The conveying piston is arranged in the conveying cylinder. The piston rod is fastened to the drive piston for motion coupling to or motion transmission to the conveying piston. Furthermore, the drive cylinder has a rod-side passage or inlet for the pressurization of a rod side of the drive piston with hydraulic liquid and a crown-side passage or inlet for the pressurization of a crown side, which is averted from or situated opposite the rod side, of the drive piston with hydraulic liquid. Furthermore, the apparatus has an in particular controllable drive pump or drive pump unit, at least one pump connection, an in particular electrical sensor device and an in particular electrical control unit. The drive pump is designed to generate a drive volume flow, with a drive pressure, of hydraulic liquid for the movement of the drive piston, in particular in the drive cylinder, and thus in particular to move the piston rod and thus the conveying piston, in particular in the conveying cylinder. The pump connection is designed for the changeable, in particular operator-changeable or detachable, connection of the drive pump, in particular of a high-pressure side of the drive pump, to in particular either the rod-side passage or to the crown-side passage for the flow of hydraulic liquid, in particular from the drive pump to the drive piston. The sensor device is designed to independently or autonomously or automatically detect or identify whether the pump connection is connected to the rod-side passage or to the crown-side passage. The control unit is designed to in particular independently or autonomously or automatically control the apparatus, in particular the drive pump, in a rod-side operating mode if a rod-side pump connection is detected and in a crown-side operating mode, which in particular differs from the rod-side operating mode, if a crown-side pump connection is detected.

The apparatus allows in particular repeatable or multiple changing or switching between rod-side and crown-side drive, in particular by an operator. Thus, the apparatus permits a change of a transmission ratio between a drive side, in particular the drive cylinder and/or the drive piston, and a conveying side, in particular the conveying cylinder and/or the conveying piston. The apparatus thus allows a change of attainable values for conveying pressure and conveying volume flow, in particular in the presence of constant drive pressure or drive pressure value and constant drive volume flow or drive volume flow value.

In detail, the rod side and the crown side may have an equal area or an equal area value. However, the piston rod fastened to the drive piston may occupy a part of the area of the rod side and thus prevent the hydraulic liquid from using the partial area for the exertion of the drive pressure. By contrast, the full area of the crown side can be available to the hydraulic liquid for the exertion of the drive pressure. Thus, a force or a force value transmitted by the hydraulic liquid with the drive pressure to the crown side can be higher than a force or a force value on the rod side. The apparatus can thus have the in particular different transmission ratios. In particular, the crown-side pump connection or the crown-side operating mode may be used or utilized for high-pressure conveyance. The rod-side pump connection or the rod-side operating mode may be used or utilized for low-pressure conveyance.

Furthermore, the piston rod in the drive cylinder on the rod side may occupy a partial volume and thus prevent the hydraulic liquid from filling the partial volume. By contrast, a volume in the drive cylinder on the crown side can be fully available for filling by the hydraulic liquid. Thus, in the case of crown-side filling or charging of the drive cylinder, a movement or a travel value of the drive piston caused by the hydraulic liquid with the drive volume can be shorter or lower than a movement or a travel value of the drive piston in the case of rod-side filling or charging of the drive cylinder with the drive volume. The apparatus can thus have the in particular different transmission ratios. In particular, the rod-side pump connection or the rod-side operating mode may be used or utilized for high-volume conveyance. The crown-side pump connection or the crown-side operating mode may be used or utilized for low-volume conveyance.

In particular, the transmission ratios may differ from one another by a value of 1.1 to 2.5, in particular of 1.2 to 2.2, in particular of 1.3 to 1.9, in particular of 1.4 to 1.6, in particular of 1.5.

The rod side may refer to that side, in particular that face side, of the drive piston at which the piston rod is fastened to the drive piston. The crown side may refer to the averted or opposite side, in particular face side, of the drive piston. In addition or alternatively, the crown side does not need to be at the bottom.

The piston rod may be fastened to the conveying piston.

The pump connection may have or be a pump connecting line, in particular a hydraulic hose line. In addition or alternatively, the pump connection may be connected to the drive pump and designed for changeable connection to the rod-side passage or to the crown-side passage.

A rod-side pump connection may refer to the connection of the pump connection to the rod-side passage. A crown-side pump connection may refer to the connection of the pump connection to the crown-side passage.

Furthermore, the apparatus or its sensor device makes it possible for the rod-side pump connection and the crown-side pump connection, or the active pump connection side, to be independently detected. In other words: the operator does not need to input the active pump connection side into the control unit after a change between rod-side and crown-side drive.

In particular, the sensor device may be referred to as detection device or identification device. In detail, the sensor device may have at least one sensor and/or an evaluation unit such as a processor. The at least one sensor and the evaluation unit may have a signal connection to one another.

Furthermore, the apparatus or its control unit or its rod-side operating mode and its crown-side operating mode enable the apparatus, in particular the drive pump, to be optimally and/or reliably controlled.

In particular, in the crown-side operating mode or in the high-pressure conveying operating mode, conveyance through a conveying line on an arm assembly or a mast, in particular of the apparatus, may be prevented, or an operating duration may be limited, in particular in order to reduce or even fully eliminate adverse effects on a service life of components, in particular of the apparatus. By contrast, in the rod-side operating mode or in the low-pressure conveyance operating mode, unlimited operation may be possible or enabled. In addition or alternatively, the control unit may be designed to control the apparatus in the rod-side operating mode if a rod-side pump connection is detected and to control the apparatus in the crown-side operating mode, which in particular differs from the rod-side operating mode, if a crown-side pump connection is detected, with at least one operating parameter, in particular one value of the operating parameter, which is adapted to the respective pump connection, in particular rod-side or crown-side pump connection. In particular, the at least one/multiple operating parameter(s), in particular a value of the operating parameter, may differ in the rod-side operating mode and in the crown-side operating mode. In addition or alternatively, in the crown-side operating mode, a conveying pressure and/or the drive pressure and/or an operating duration may be limited and/or conveyance through a conveying line of an arm assembly may be prevented. It is furthermore additionally or alternatively possible for unlimited operation to be enabled in the rod-side operating mode.

The control unit may have a processor and/or a memory. In addition or alternatively, the control unit may have a, in particular a respective, signal connection to the sensor device and/or to the drive pump.

Additionally, the apparatus may have an in particular electrical output device. The output device may be designed to in particular automatically output the detected pump connection side and/or the operating mode, in particular to the operator. In particular, the output device may have or be a display. In addition or alternatively, the output device may have a, in particular a respective, signal connection to the sensor device and/or to the control unit.

The apparatus may be referred to as a thick matter pump. Thick matter may refer to mortar, cement, screed, concrete, plaster and/or sludge. In addition or alternatively, for the conveying action, the conveying piston may act on the thick matter, in particular may be in immediate or direct contact with the thick matter. It is furthermore additionally or alternatively possible for the apparatus to be in the form of a mobile apparatus.

In one refinement of the invention, the apparatus has at least two drive cylinders and at least two drive pistons. Furthermore, the apparatus has at least one oscillation connection. The oscillation connection is designed for the changeable, in particular operator-changeable or detachable, connection of in particular either crown-side passages or rod-side passages of the drive cylinder for a flow of hydraulic liquid, in particular between the drive cylinders, such that the drive pistons are coupled in terms of phase, in particular are coupled in antiphase or for opposing movement. This makes it possible for gaps in the conveyance of thick matter to be reduced, in particular in relation to an apparatus with only a single drive cylinder and only a single drive piston, or even eliminated entirely. In particular, the apparatus may have at least two conveying cylinders, at least two conveying pistons, at least two piston rods and/or at least two pump connections. In addition or alternatively, the oscillation connection may have or be an oscillation connection line, in particular a hydraulic hose line. It is furthermore additionally or alternatively possible for the oscillation connection to be designed for variable connection to the crown-side passages or to the rod-side passages. It is furthermore additionally or alternatively possible for the oscillation connection to be connected to those passages which are not connected by the pump connection. In other words: the oscillation connection side can be opposite to the pump connection side. In particular, the drive pump, the at least one pump connection, the drive cylinder and the oscillation connection may form an in particular open or closed circuit for hydraulic liquid. An open circuit may refer to a flow of hydraulic liquid from a tank through the drive pump, the pump connection, the drive cylinders and the oscillation connection to the tank. A closed circuit may refer to a flow of hydraulic liquid from the drive pump, in particular a high-pressure side of the drive pump, through the pump connection, the drive cylinders, the oscillation connection and a further pump connection to the pump, in particular to a low-pressure side or suction side of the drive pump. It is furthermore additionally or alternatively possible for the sensor device to be designed to independently detect whether the oscillation connection is connected to the crown-side passages or to the rod-side passages, and thus to independently detect whether the pump connection is connected to the rod-side passage or to the crown-side passage.

In one refinement of the apparatus, the sensor device is designed to in particular automatically measure at least one characteristic variable dependent on the pump connection side or on the in particular respective transmission ratio, in particular a value or magnitude of the characteristic variable, of the drive piston, of the conveying piston, of the piston rod, of the hydraulic liquid and/or of the thick matter in detection operation of the drive pump. Furthermore, the sensor device is designed to in particular automatically detect the pump connection side based on the measured characteristic variable. This allows an indirect detection of the pump connection side. In other words: the sensor device does not need to be designed to directly detect the connection of the pump connection side to the rod-side passage or to the crown-side passage. In particular, the control unit may be designed to in particular automatically control the drive pump in a detection operating mode. In addition or alternatively, the detection operation or the detection operating mode may differ from the rod-side operating mode and/or the crown-side operating mode. In particular, loads on components, in particular of the apparatus, can be reduced in the detection operating mode.

In one configuration of the invention the sensor device is designed to, based on the drive volume flow and/or a drive pump pressure, in particular the drive pressure, in particular automatically determine, in particular calculate and/or measure, at least one comparison variable, in particular a value or magnitude of the comparison variable. Furthermore, the sensor device is designed to, in particular automatically, compare the comparison variable with the characteristic variable and/or with a variable based on the characteristic variable. Furthermore, the sensor device is designed to in particular automatically detect the pump connection side based on a comparison result. In particular, the comparison result may be referred to as a specification variable or setpoint variable. In addition or alternatively, the sensor device may be designed to determine a rod-side comparison variable and a crown-side comparison variable, which may in particular differ from one another in terms of the transmission ratios. It is furthermore additionally or alternatively possible for the drive pump pressure to be a high pressure, in particular of a high-pressure side of the drive pump, or a low pressure, in particular of a low-pressure side of the drive pump. It is furthermore additionally or alternatively possible for the comparison variable to be the drive volume flow and/or the drive pump pressure.

In one configuration of the invention, the sensor device has an in particular electrical position detection device. The position detection device is designed to in particular automatically detect at least two, in particular different, positions, in particular end positions, of the drive piston, in particular in the drive cylinder, of the conveying piston, in particular in the conveying cylinder, and/or of the piston rod. Furthermore, the sensor device is designed to in particular automatically detect the pump connection side based on the detection of the positions. In particular, the characteristic variable may have or be the at least two positions. In addition or alternatively, the position detection device may have at least two position switches, in particular end position switches, or a travel measuring system.

In one configuration of the invention, the sensor device has an in particular electrical time measuring device. The time measuring device is designed to in particular automatically measure a movement duration, in particular a value or magnitude of the movement duration, of the drive piston, of the conveying piston and/or of the piston rod between the positions, in particular the end positions. Furthermore, the sensor device is designed to in particular automatically detect the pump connection side based on the measured movement duration. In particular, the characteristic variable may have or be the movement duration. The sensor device may compare the measured movement duration with a comparison movement duration, in particular based on the drive volume flow. In addition or alternatively, the characteristic variable may have or be a speed of the drive piston, of the conveying piston and/or of the piston rod. The speed may be determined, in particular calculated, from a distance between the positions and the movement duration. The sensor device may compare the measured speed with a comparison speed, in particular based on the drive volume flow.

In one configuration of the invention, the apparatus has an infeed and/or outfeed. The infeed and/or outfeed is designed for the in particular automatic infeed and/or outfeed of hydraulic liquid into the oscillation connection side situated opposite the pump connection side. The sensor device, in particular the at least one position detection device, is designed to in particular automatically measure a phase change, in particular a value or magnitude of the phase change, of the drive piston, of the conveying piston and/or of the piston rods in the case of infeed or outfeed. Furthermore, the sensor device is designed to in particular automatically detect the pump connection side based on the measured phase change. In particular, the characteristic variable may have or be the phase change. The sensor device may compare the measured phase change with a comparison phase change, in particular based on the infeed or outfeed, and detect the oscillation connection side and/or the pump connection side based on a comparison result. In detail, the drive piston, the conveying piston and/or the piston rods, or their positions detected in particular by means of the position device, may have a phase position with respect to one another, in particular 180 degrees. The phase position may change, in particular in an unintended manner, in particular as a result of at least one leak. The phase position may have been or be changed, in particular in one direction or an opposite direction, as a result of infeed or outfeed. In addition or alternatively, the infeed and/or outfeed may have an infeed and/or outfeed valve.

In one configuration of the invention, the sensor device has at least one, in particular electrical, pressure measuring device. The pressure measuring device is designed to in particular automatically measure a pressure, in particular a value or a magnitude of the pressure, of the hydraulic liquid, in particular in the drive cylinder, and/or of the thick matter, in particular in the conveying cylinder. Furthermore, the sensor device is designed to in particular automatically detect the pump connection side based on the measured pressure. In particular, the characteristic variable may have or be the pressure. The sensor device may compare the measured pressure with a comparison pressure, in particular based on the drive pump pressure.

In one configuration of the invention, the sensor device has at least one further, in particular electrical, pressure measuring device. The further pressure measuring device is designed to in particular automatically measure a, in particular the, drive pump pressure, in particular a value or a magnitude of the drive pump pressure, of the hydraulic liquid. Furthermore, the sensor device is designed to in particular automatically compare the measured drive pump pressure with the measured pressure. Furthermore, the sensor device is designed to in particular automatically detect the pump connection side based on a comparison result. In particular, the comparison variable may have or be the drive pump pressure.

In one refinement of the invention, the pump connection and/or the oscillation connection, if present, have/has in particular in each case at least one identification element of the sensor device. The rod-side passage and/or the crown-side passage have/has in particular in each case one in particular electrical identification detection device of the sensor device. The identification detection device is designed to in particular automatically detect the identification element. In addition or alternatively, the rod-side passage and/or the crown-side passage have/has in particular in each case one identification element of the sensor device. The pump connection and/or the oscillation connection, if present, have/has in particular in each case at least one in particular electrical identification detection device of the sensor device. The identification detection device is designed to in particular automatically detect the identification element. The sensor device is designed to in particular automatically detect the pump connection side based on the detection and/or a non-detection of the identification element. This allows a direct detection of the pump connection side. In particular, the identification detection may be contactless, in particular an RFID detection. In addition or alternatively, the identification detection may involve contact.

In one refinement of the invention, the sensor device has at least one, in particular electrical, optical detection device, in particular a camera. The optical detection device is designed to in particular automatically optically detect the connection of the pump connection and/or of the oscillation connection, if present, to the rod-side passage or to the crown-side passage. This allows a direct detection of the pump connection side.

BRIEF DESCRIPTION OF THE DRAWINGS

Further advantages and aspects of the invention will emerge from the claims and from the following description of preferred exemplary embodiments of the invention, which are discussed below based on the figures.

DETAILED DESCRIPTION OF THE EXEMPLARY EMBODIMENTS

The apparatus 1 for conveying thick matter DS has at least one drive cylinder 10*a*, 10*b*, at least one drive piston 11*a*, 11*b*, at least one conveying cylinder 12*a*, 12*b*, at least one conveying piston 13*a*, 13*b*, and at least one piston rod 14*a*, 14*b*. The drive cylinder 10*a*, 10*b* is designed to receive hydraulic liquid HF. The drive piston 11*a*, 11*b* is arranged in the drive cylinder 10*a*, 10*b*. The conveying cylinder 12*a*, 12*b* is designed to receive thick matter DS. The conveying piston 13*a*, 13*b* is arranged in the conveying cylinder 12*a*, 12*b*. The piston rod 14*a*, 14*b* is fastened to the drive piston 11*a*, 11*b* for motion coupling to the conveying piston 13*a*, 13*b*. Furthermore, the drive cylinder 10*a*, 10*b* has a rod-side passage SDa, SDb for the pressurization of a rod side SKa, SKb of the drive piston 11*a*, 11*b* with hydraulic liquid HF and has a crown-side passage BDa, BDb for the pressurization of a crown side BKa, BKb, which is averted from the rod side SKa, SKb, of the drive piston 11*a*, 11*b* with hydraulic liquid HF. Furthermore, the apparatus has a drive pump 20, at least one pump connection 30*a*, 30*b*, a sensor device 40 and a control unit 50. The drive pump 20 is designed to generate a drive volume flow AVF, with a drive pressure pA, of hydraulic liquid HF for the movement of the drive piston 11*a*, 11*b*. The pump connection 30*a*, 30*b* is designed for the changeable connection of the drive pump 20 to the rod-side passage SDa, SDb or to the crown-side passage BDa, BDb for the flow of hydraulic liquid HF. The sensor device 40 is designed to independently detect whether the pump connection 30*a*, 30*b* is connected to the rod-side passage SDa, SDb or to the crown-side passage BDa, BDb. The control unit 50 is designed to control the apparatus 1, in particular the drive pump 20, in a rod-side operating mode if a rod-side pump connection is detected and in a crown-side operating mode if a crown-side pump connection is detected.

Figure 1:
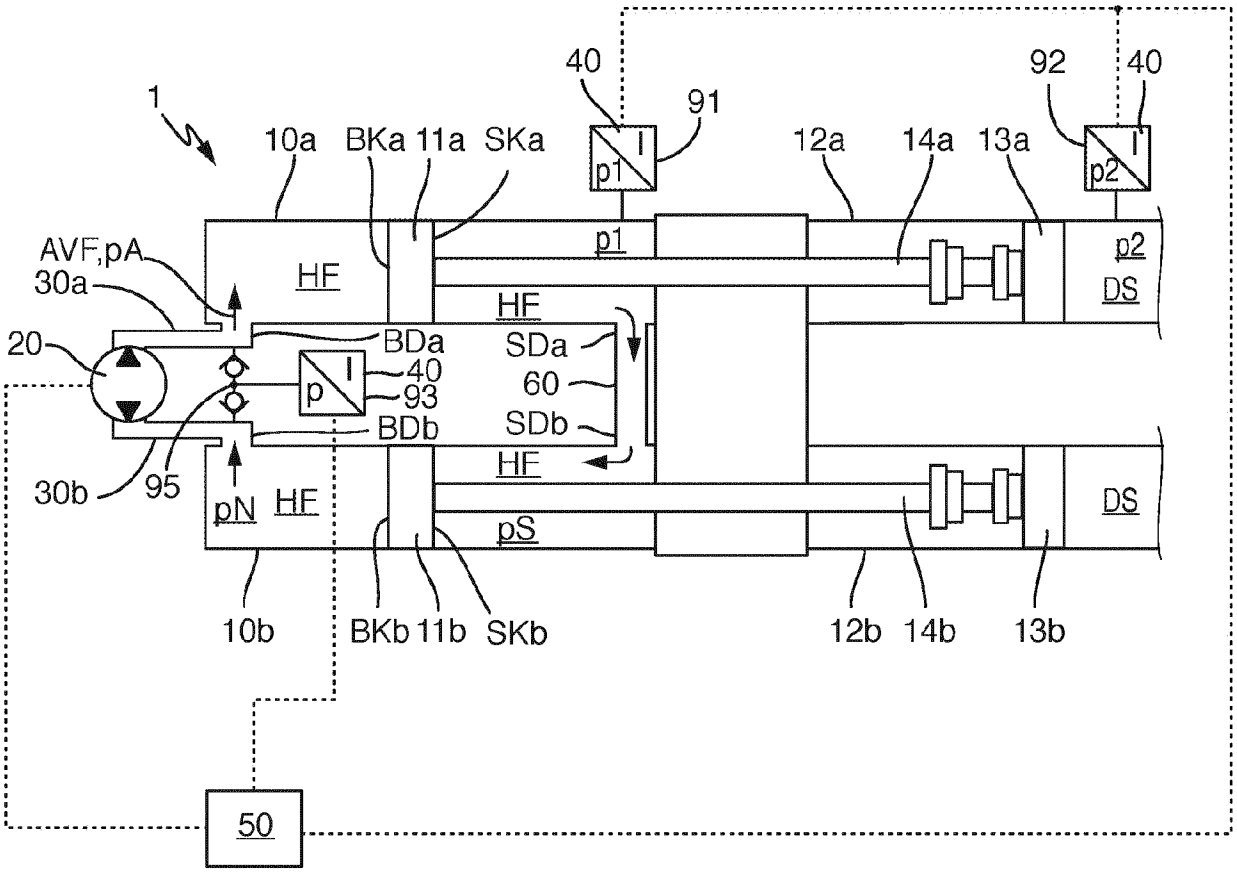
FIG. 1 shows a schematic circuit diagram of an exemplary apparatus according to the invention for conveying thick matter, comprising a sensor device having at least one pressure measuring device.

In detail, the apparatus 1 has a transmission ratio which is dependent on the pump connection side. The piston rod 14*a*, 14*b* occupies a partial area and a partial volume on the rod side SKa, SKb, as can be seen in FIG. 1.

In the exemplary embodiment shown, the apparatus 1 has two drive cylinders 10*a*, 10*b* and two drive pistons 11*a*, 11*b*. Additionally, the apparatus 1 has two conveying cylinders 12*a*, 12*b*, two conveying pistons 13*a*, 13*b*, two piston rods 14*a*, 14*b* and two pump connections 30*a*, 30*b*.

In alternative exemplary embodiments, the apparatus may have only a single drive cylinder, only a single drive piston, only a single conveying cylinder, only a single conveying piston, only a single piston rod and only a single pump connection.

Furthermore, in the exemplary embodiment shown, the apparatus 1 has an oscillation connection 60. The oscillation connection 60 is designed for the changeable connection of the crown-side passages BDa, BDb or of the rod-side passages SDa, SDb of the drive cylinders 10*a*, 10*b* for a flow of hydraulic liquid HF, such that the drive pistons 11*a*, 11*b* are coupled in terms of phase, in particular are coupled in antiphase.

In detail, the drive pump 20, the pump connections 30*a*, 30*b*, the drive cylinders 10*a*, 10*b* and the oscillation connection 60 form a closed circuit for hydraulic liquid HF. In alternative exemplary embodiments, the drive pump, the at least one pump connection, the drive cylinders and the oscillation connection may form an open circuit for hydraulic liquid.

Furthermore, in FIGS. 1 to 11, the sensor device 40 is designed to measure at least one characteristic variable P1*a*, P1*b*, P2*a*, P2*b*, Ta, Tb, PV, p1, p2, which is dependent on the pump connection side, of the drive piston 11*a*, 11*b*, of the hydraulic liquid HF and/or of the thick matter DS in detection operation of the drive pump 20. In alternative exemplary embodiments, the sensor device may additionally or alternatively be designed to measure at least one characteristic variable, which is dependent on the pump connection side, of the conveying piston and/or of the piston rod in detection operation of the drive pump. Furthermore, in the exemplary embodiment shown, the sensor device 40 is designed to detect the pump connection side based on the measured characteristic variable P1*a*, P1*b*, P2*a*, P2*b*, Ta, Tb, PV, p1, p2.

In detail, the sensor device 40 is designed to, based on the drive volume flow AVF and/or a drive pump pressure pA, in particular the drive pressure pA, determine at least one comparison variable VG. Furthermore, the sensor device 40 is designed to compare the comparison variable VG with the characteristic variable P1*a*, P1*b*, P2*a*, P2*b*, Ta, Tb, PV, p1, p2. In alternative exemplary embodiments, the sensor device may additionally or alternatively be designed to compare the comparison variable with a variable based on the characteristic variable. Furthermore, the sensor device 40 is designed to detect the pump connection side based on a comparison result.

In FIGS. 1 to 7, the sensor device 40 has at least one pressure measuring device 91, 92. The pressure measuring device 91, 92 is designed to measure a pressure p1, p2 of the hydraulic liquid HF and/or of the thick matter DS. Furthermore, the sensor device 40 is designed to detect the pump connection side based on the measured pressure p1, p2.

In detail, in FIG. 1, the sensor device has two pressure measuring devices 91, 92. The pressure measuring device 91 is designed to measure the pressure p1 of the hydraulic liquid HF. The pressure measuring device 92 is designed to measure the pressure p2 of the thick matter DS. In alternative exemplary embodiments, the sensor device may have only a single pressure measuring device, which may be designed to measure the pressure, in particular either of the hydraulic liquid or of the thick matter.

Furthermore, in FIGS. 1 to 7, the pressure measuring device 91 is arranged at the rod side, in particular on the drive cylinder 10*a*. In detail, the pressure measuring device 91 is arranged at a rod-side end of the drive cylinder 10*a* or at the rod-side passage SDa. In alternative exemplary embodiments, the pressure measuring device may be arranged at the crown side, in particular on the drive cylinder, in particular at a crown-side end of the drive cylinder or at the crown-side passage.

Furthermore, in FIGS. 1 to 7, the apparatus 1 has a further pressure measuring device 93. The further pressure measuring device 93 is designed to measure the drive pump pressure pA, in particular the drive pressure pA, of the hydraulic liquid HF. Furthermore, the sensor device 40 is designed to compare the measured drive pump pressure pA with the measured pressure p1, p2 and to detect the pump connection side based on a comparison result.

In detail, the apparatus 1 or its sensor device 40 has a valve 95. The further pressure measuring device 93 is connected by means of the valve 95 to the drive pump 20. In particular, the valve 95 is designed to in particular automatically connect the further pressure measuring device 93 to a high-pressure side HD of the drive pump 20 for the purposes of measuring the drive pressure pA. In alternative exemplary embodiments, the valve may be designed to in particular automatically connect the further pressure measuring device to a low-pressure side of the drive pump for the purposes of measuring a low-pressure.

In the exemplary embodiment shown, there are three different pressures or pressure levels: the high pressure or drive pressure pA, in particular of the drive pump 20, a drive pump pressure or the low pressure pN, in particular of the drive pump 20, and an oscillation pressure pS, in particular of the oscillation connection side. The low pressure level or the low pressure pN is fixedly set at the drive pump 20 and can thus be assumed to be approximately constant. The high pressure level or the high pressure or drive pressure pA is set by the pressure of the thick matter DS or a conveying pressure and the active pump connection side. The oscillation pressure pS is, in particular depending on the active pump connection side, proportional either to the high pressure or drive pressure pA or to the low pressure pN. In detail, the oscillation pressure pS is higher than the low pressure pN, in particular is equal to the low pressure pN multiplied by the transmission ratio. Furthermore, the oscillation pressure pS is lower than the high pressure or drive pressure pA.

Figure 2:
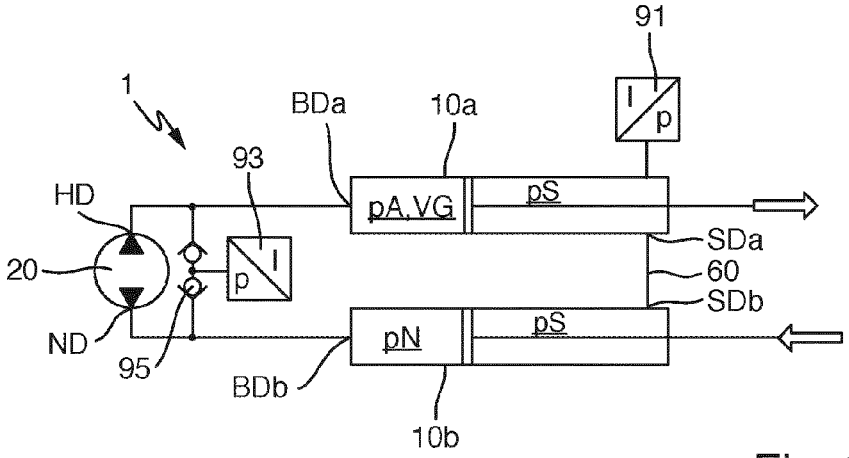
FIG. 2 is a schematic illustration of pressure conditions in the apparatus of FIG. 1 in the case of a crown-side pump connection and during a stroke.

In FIGS. 1 and 2, the drive pump 20 or its high-pressure side HD is connected by means of the pump connection 30*a* to the crown-side passage BDa of the drive cylinder 10*a* for the flow of hydraulic liquid HF, in particular from the drive pump 20 to the drive piston 11*a*. Thus, in FIGS. 1 and 2, the drive piston 11*a* moves to the right, as indicated by an arrow. Furthermore, the oscillation connection 60 is connected to the rod-side passages SDa, SDb of the drive cylinders 10*a*, 10*b* for the flow of hydraulic liquid HF, in particular from the drive cylinder 10*a* to the drive cylinder 10*b*. Thus, in FIGS. 1 and 2, the drive piston 11*b* thus moves to the left, as indicated by an arrow.

Here, the pressure measuring device 91 measures the oscillation pressure pS. The further pressure measuring device 93 measures the high pressure or drive pressure pA.

Furthermore, the sensor device 40 compares the high pressure or drive pressure pA, in particular as comparison variable VG, with the oscillation pressure pS, in particular as characteristic variable.

Here, the connection of the drive pump 20 or of its high-pressure side HD either to the drive cylinder 10*a* or to the drive cylinder 10*b*, or a direction of the flow of the hydraulic liquid HF, in particular from the drive pump 20 either to the drive piston 11*a* or to the drive piston 11*b*, is known to the sensor device 40.

The sensor device 40 thus detects the crown-side pump connection based on the comparison result.

Figure 3:
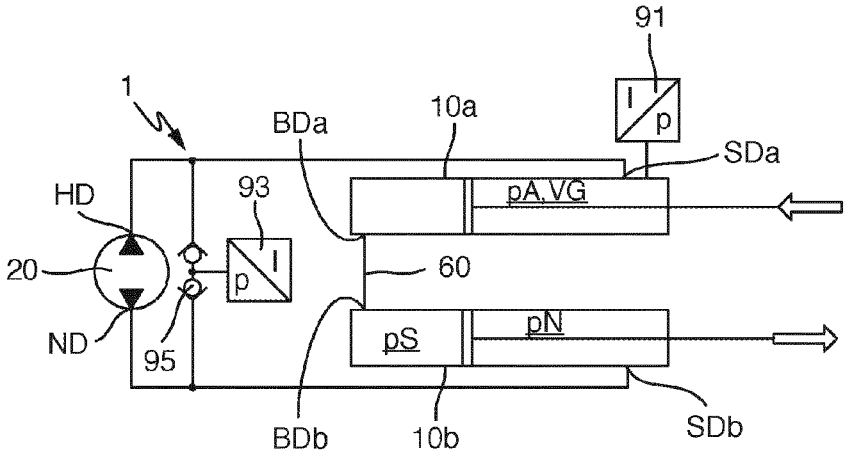
FIG. 3 is a schematic illustration of pressure conditions in the apparatus of FIG. 1 in the case of a rod-side pump connection and during an oppositely directed stroke.

In FIG. 3, the drive pump 20 or its high-pressure side HD is connected by means of the pump connection 30*a* to the rod-side passage SDa of the drive cylinder 10*a* for the flow of hydraulic liquid HF, in particular from the drive pump 20 to the drive piston 11*a*. Thus, in FIG. 3, the drive piston 11*a* moves to the left, as indicated by an arrow. Furthermore, the oscillation connection 60 is connected to the crown-side passages BDa, BDb of the drive cylinders 10*a*, 10*b* for the flow of hydraulic liquid HF, in particular from the drive cylinder 10*a* to the drive cylinder 10*b*. Thus, in FIG. 3, the drive piston 11*b* moves to the right, as indicated by an arrow.

Here, the pressure measuring device 91 measures the high pressure or drive pressure pA. The further pressure measuring device 93 measures the high pressure or drive pressure pA.

Furthermore, the sensor device 40 compares the high pressure or drive pressure pA, in particular as comparison variable VG, with the high pressure or drive pressure pA, in particular as characteristic variable.

The sensor device 40 thus detects the rod-side pump connection.

Figure 4:
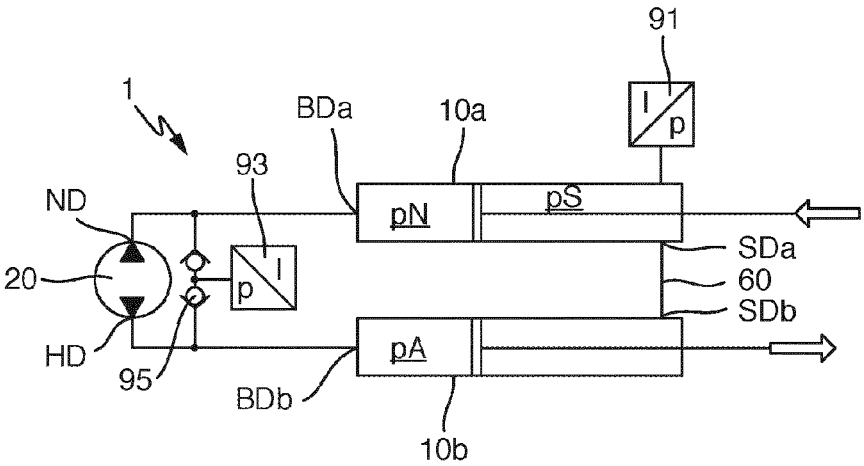
FIG. 4 is a schematic illustration of pressure conditions in the apparatus of FIG. 1 in the case of a crown-side pump connection and during an oppositely directed stroke.

In FIG. 4, the drive pump 20 or its high-pressure side HD is connected by means of the pump connection 30*b* to the crown-side passage BDb of the drive cylinder 10*b* for the flow of hydraulic liquid HF, in particular from the drive pump 20 to the drive piston 11*b*. Thus, in FIG. 4, the drive piston 11*b* moves to the right, as indicated by an arrow. Thus, in FIG. 4, the drive piston 11*a* moves to the left, as indicated by an arrow.

Here, the pressure measuring device 91 measures the oscillation pressure pS. The further pressure measuring device 93 measures the high pressure or drive pressure pA. Thus, the sensor device 40 detects the crown-side pump connection.

Figure 5:
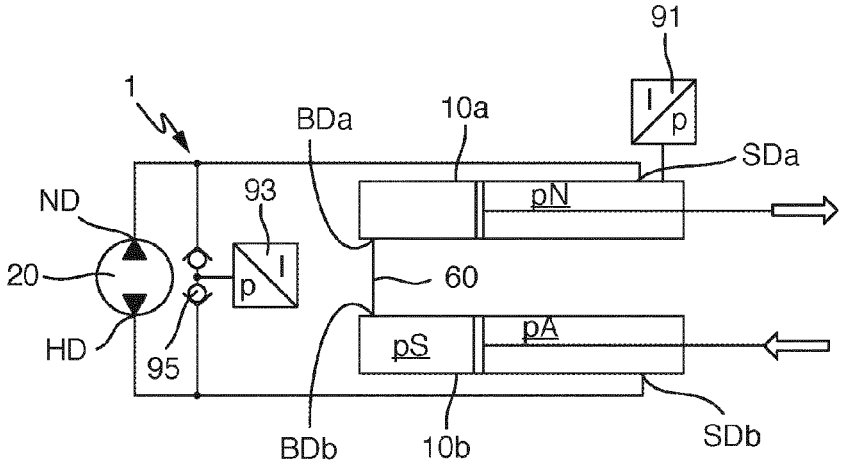
FIG. 5 is a schematic illustration of pressure conditions in the apparatus of FIG. 1 in the case of a rod-side pump connection and during a stroke.

In FIG. 5, the drive pump 20 or its high-pressure side HD is connected by means of the pump connection 30*a* to the rod-side passage SDb of the drive cylinder 10*b* for the flow of hydraulic liquid HF, in particular from the drive pump 20 to the drive piston 11*b*. Thus, in FIG. 5, the drive piston 11*b* moves to the left, as indicated by an arrow. Thus, in FIG. 5, the drive piston 11*a* moves to the right, as indicated by an arrow.

Here, the pressure measuring device 91 measures the low pressure pN. The further pressure measuring device 93 measures the high pressure or drive pressure pA. Thus, the sensor device 40 detects the rod-side pump connection.

Figure 6:
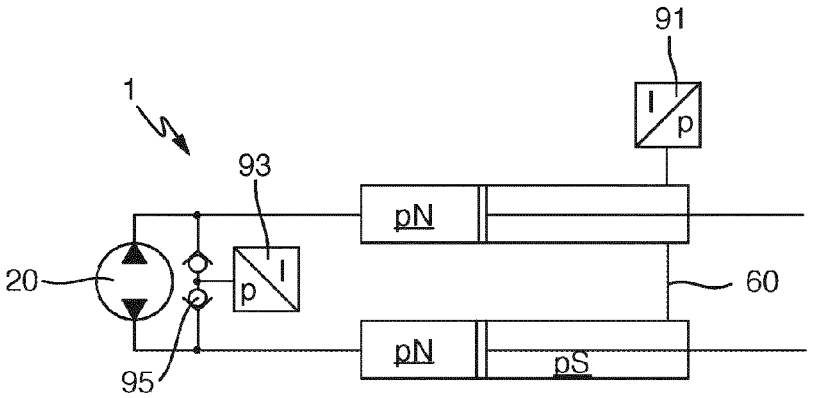
FIG. 6 is a schematic illustration of pressure conditions in the apparatus of FIG. 1 in the case of a crown-side pump connection and in the absence of a stroke.

In FIG. 6, the drive pump 20 is connected by means of the pump connections 30*a*, 30*b* to the crown-side passages BDa, BDb of the drive cylinders 10*a*, 10*b*. Furthermore, the drive pump 20 is inactive, or is not generating any flow of hydraulic liquid HF. Thus, neither of the drive pistons 11*a*, 11*b* is moving.

Here, the pressure measuring device 91 measures the oscillation pressure pS. The further pressure measuring device 93 measures the low pressure pN. Thus, the sensor device 40 detects the crown-side pump connection.

Figure 7:
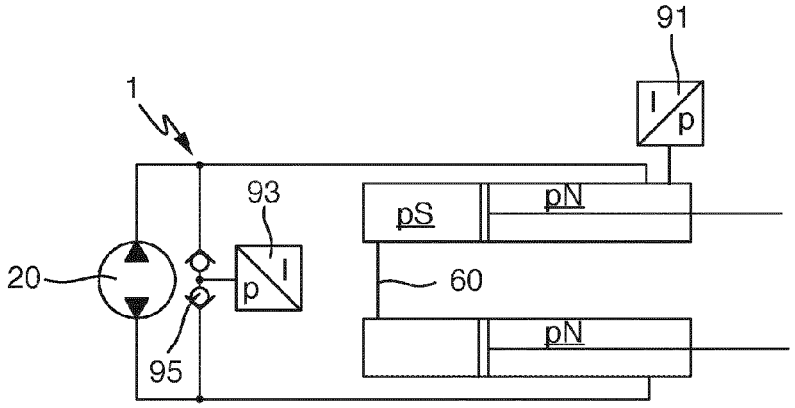
FIG. 7 is a schematic illustration of pressure conditions in the apparatus of FIG. 1 in the case of a rod-side pump connection and in the absence of a stroke.

In FIG. 7, the drive pump 20 is connected by means of the pump connections 30*a*, 30*b* to the rod-side passages SDa, SDb of the drive cylinders 10*a*, 10*b*. Furthermore, the drive pump 20 is inactive, or is not generating any flow of hydraulic liquid HF. Thus, neither of the drive pistons 11*a*, 11*b* is moving.

Here, the pressure measuring device 91 measures the low pressure pN. The further pressure measuring device 93 measures the low pressure pN. Thus, the sensor device 40 detects the rod-side pump connection.

In FIGS. 2 to 7, in particular in FIGS. 2 to 5, the connection of the drive pump 20 or of its high-pressure side HD either to the drive cylinder 10*a* or to the drive cylinder 10*b*, or a direction of the flow of the hydraulic liquid HF, in particular from the drive pump 20 either to the drive piston 11*a* or to the drive piston 11*b*, is known to the sensor device 40. In alternative exemplary embodiments, this does not need to be known to the sensor device. In particular, the sensor device may be designed to compare opposite strokes or movements of the drive pistons, specifically the movements shown in FIGS. 2 and 4 with one another or the movements shown in FIGS. 3 and 5 with one another. Furthermore additionally or alternatively, in alternative exemplary embodiments, the apparatus does not need to have the further pressure measuring device. In particular, the high pressure or drive pressure, the low pressure and/or the oscillation pressure may be known to the sensor device.

In FIGS. 8 to 11, the sensor device 40 has a position detection device 70*a*, 70*b*. The position detection device 70*a*, 70*b* is designed to detect at least two positions P1*a*, P1*b*, P2*a*, P2*b* of the drive piston 11*a*, 11*b*. In alternative exemplary embodiments, the position detection device may additionally or alternatively be designed to detect at least two positions of the conveying piston and/or of the piston rod. Furthermore, the sensor device 40 is designed to detect the pump connection side based on the detection of the positions P1*a*, P1*b*, P2*a*, P2*b*.

In detail, the sensor device 40 has two position detection devices 70*a*, 70*b*. In alternative exemplary embodiments, the sensor device may have only a single position detection device.

Figure 8:
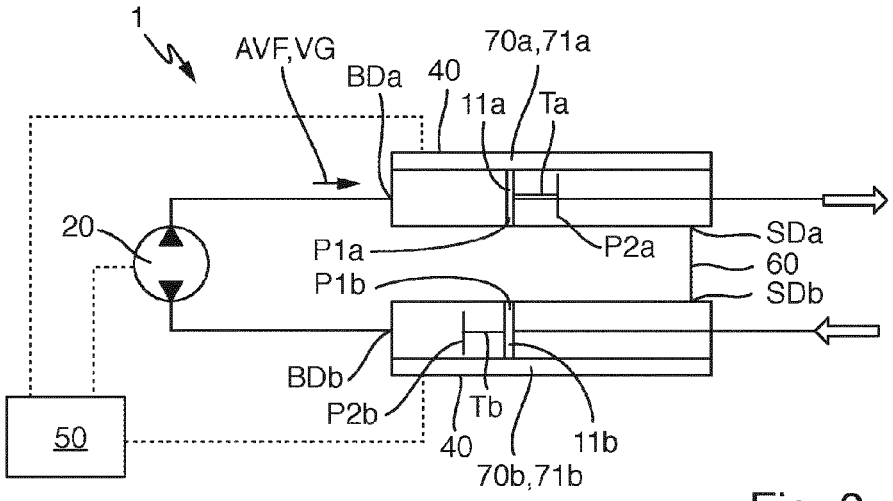
FIG. 8 shows a further schematic circuit diagram of the apparatus for conveying thick matter, comprising the sensor device having at least one position detection device and at least one time measuring device, in the case of a crown-side pump connection and during a stroke.
Figure 9:
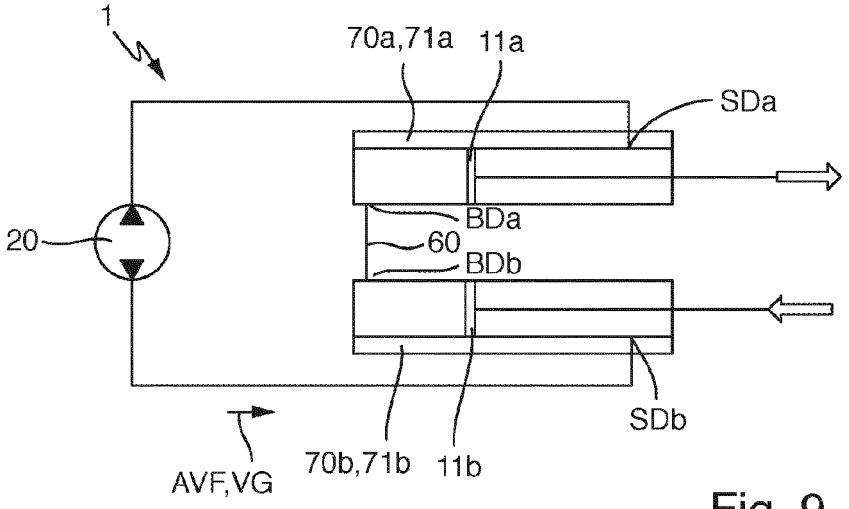
FIG. 9 is a schematic illustration of the apparatus of FIG. 8 in the case of a rod-side pump connection and during a stroke.

Furthermore, in FIGS. 8 and 9, the sensor device 40 has a time measuring device 71*a*, 71*b*. The time measuring device 71*a*, 71*b* is designed to measure a movement duration Ta, Tb of the drive piston 11*a*, 11*b* between the positions P1*a*, P1*b*, P2*a*, P2*b*. In alternative exemplary embodiments, the time measuring device may additionally or alternatively be designed to measure a movement duration of the conveying piston and/or of the piston rod between the positions. Furthermore, the sensor device 40 is designed to detect the pump connection side based on the measured movement duration Ta, Tb.

In detail, the sensor device 40 has two time measuring devices 71*a*, 71*b*. In alternative exemplary embodiments, the sensor device may have only a single time measuring device.

The movement duration Ta, Tb is dependent on the pump connection side, in particular either the crown-side pump connection side shown in FIG. 8 or the rod-side pump connection side shown in FIG. 9, or on the in particular respective transmission ratio.

The sensor device 40 compares a comparison variable VG based on the drive volume flow AVF with the measured movement duration Ta, Tb or with a speed based thereon, in particular as characteristic variable.

Thus, based on the comparison result, the sensor device 40 detects the crown-side pump connection in FIG. 8 and the rod-side pump connection in FIG. 9.

Figure 10:
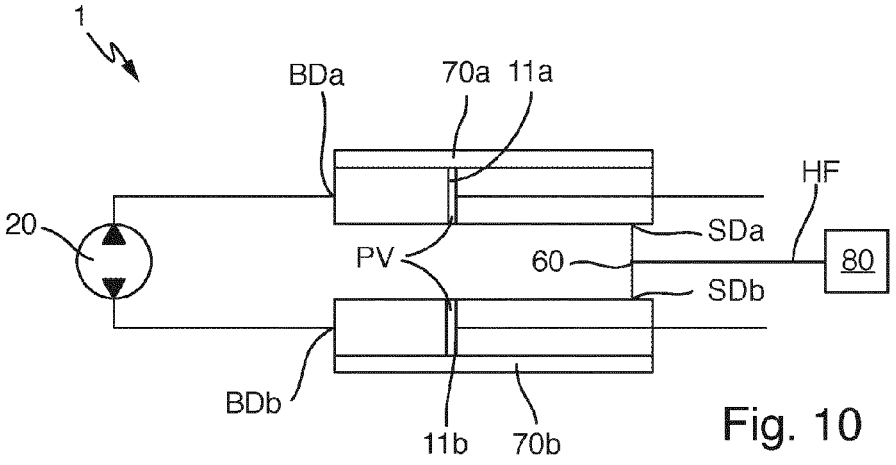
FIG. 10 shows a further schematic circuit diagram of the apparatus for conveying thick matter, comprising the sensor device having at least one position detection device and an infeed and/or outfeed, in the case of a crown-side pump connection and during a stroke.
Figure 11:
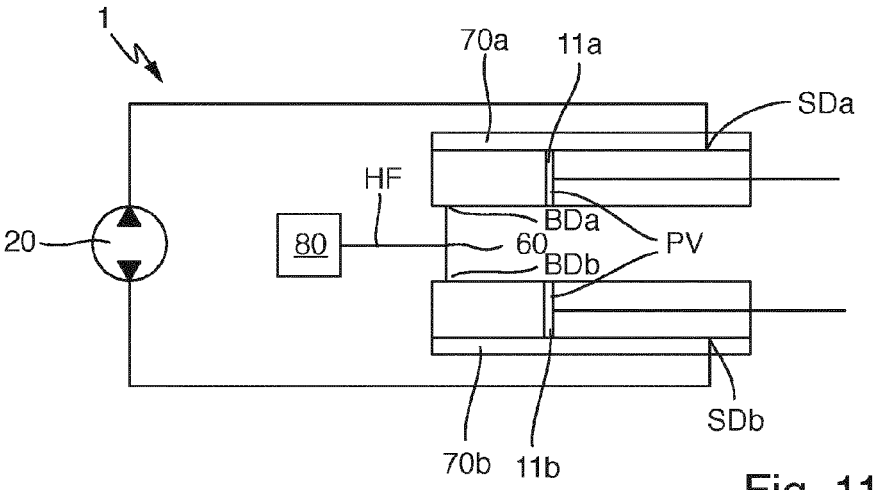
FIG. 11 is a schematic illustration of the apparatus of FIG. 10 in the case of a rod-side pump connection and during a stroke.

In FIGS. 10 and 11, the apparatus 1 has an infeed and/or outfeed 80. The infeed and/or outfeed is designed for the infeed and/or outfeed of hydraulic liquid HF into the oscillation connection side situated opposite the pump connection side. The sensor device 40 is designed to measure a phase change PV of the drive piston 11*a*, 11*b* in the case of infeed or outfeed. In alternative exemplary embodiments, the sensor device may be designed to measure a phase change of the conveying piston and/or of the piston rods in the case of infeed or outfeed. Furthermore, the sensor device 40 is designed to detect the pump connection side based on the measured phase change PV.

In detail, the sensor device 40 compares the measured phase change PV, in particular as characteristic variable, with an in particular crown-side or rod-side comparison phase change, in particular based on the infeed or outfeed, and detects the oscillation connection side and/or the pump connection side based on a comparison result.

In the case of a crown-side pump connection as shown in FIG. 10, an infeed leads to a movement of the drive piston 11*a*, 11*b* to the left. The movement is detected by means of the at least one position detection device 70*a*, 70*b*. By contrast, in the case of a rod-side pump connection as shown in FIG. 11, an infeed leads to a movement of the drive piston 11*a*, 11*b* to the right. Furthermore, in the case of a crown-side pump connection as shown in FIG. 10, an outfeed leads to a movement of the drive piston 11*a*, 11*b* to the right. By contrast, in the case of a rod-side pump connection as shown in FIG. 11, an outfeed leads to a movement of the drive piston 11*a*, 11*b* to the left.

Figure 12:
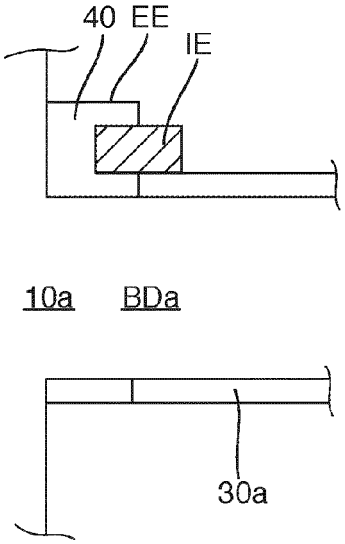
FIG. 12 is a schematic illustration of a pump connection having a contact-type identification element of the sensor device and of a crown-side passage having a contact-type identification device of the sensor device of the apparatus according to the invention for conveying thick matter.
Figure 13:
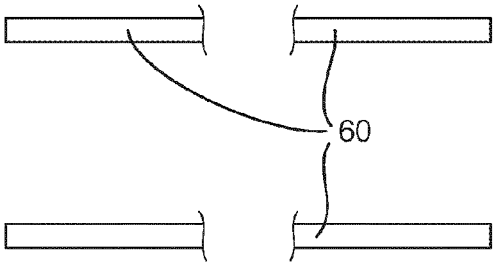
FIG. 13 is a schematic illustration of an oscillation connection of the apparatus according to the invention for conveying thick matter.
Figure 14:
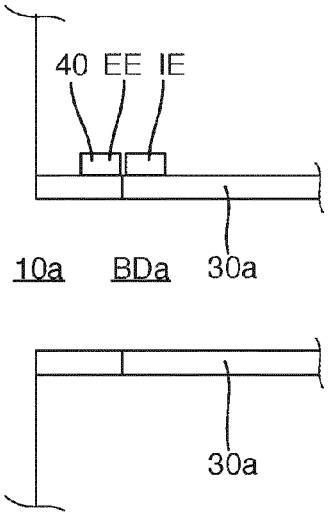
FIG. 14 is a further schematic illustration of the pump connection having a contactless identification element of the sensor device and of a crown-side passage having a contactless identification device of the sensor device of the apparatus according to the invention for conveying thick matter.

In FIGS. 12 and 14, the pump connection 30*a* has at least one identification element IE of the sensor device 40. In alternative exemplary embodiments, the oscillation connection may have at least one identification element of the sensor device. The crown-side passage BDa, in particular of the drive cylinder 10*a*, has an identification detection device EE of the sensor device 40. In alternative exemplary embodiments, the rod-side passage may have an identification detection device of the sensor device. The identification detection device EE is designed to detect the identification element IE.

In alternative exemplary embodiments, the rod-side passage and/or the crown-side passage may in particular each have an identification element of the sensor device, and the pump connection and/or the oscillation connection may in particular each have at least one identification detection device of the sensor device for detecting the identification element.

The sensor device 40 is designed to detect the pump connection side based on the detection and/or a non-detection of the identification element IE.

In detail, in FIG. 12, the identification detection involves contact, in particular the identification detection device EE has a contact switch, in particular a roller-type switch, and the identification element IE has a pin for the actuation of the contact switch.

In FIG. 14, the identification detection is contactless, in particular an RFID detection.

In the exemplary embodiment shown, the oscillation connection 60 has no identification element and no identification detection device.

In the case of a crown-side pump connection as shown in FIGS. 12 and 14, the identification detection device EE detects the identification element IE. Thus, based on the detection of the identification element IE, the sensor device 40 detects the crown-side pump connection.

In the case of a rod-side pump connection, the identification detection device EE does not detect the identification element IE. Thus, based on the non-detection of the identification element IE, the sensor device 40 detects the rod-side pump connection.

As is made clear by the exemplary embodiments shown and discussed above, the invention provides an advantageous apparatus for conveying thick matter, which permits an optimum and/or reliable conveying action.

The invention claimed is:

1. An apparatus for conveying thick matter, comprising:
- a drive cylinder for receiving hydraulic liquid;
- a drive piston which is arranged in the drive cylinder;
- a conveying cylinder for receiving the thick matter;
- a conveying piston which is arranged in the conveying cylinder;
- a piston rod which is fastened to the drive piston for motion coupling to the conveying piston,
- wherein the drive cylinder has a rod-side passage for pressurization of a rod side of the drive piston with the hydraulic liquid and has a crown-side passage for pressurization of a crown side, which is averted from the rod side, of the drive piston with the hydraulic liquid;
- a drive pump which is designed to generate a drive volume flow, with a drive pressure, of the hydraulic liquid for movement of the drive piston;
- a pump connection which is designed for a changeable connection of the drive pump to the rod-side passage or to the crown-side passage for the flow of the hydraulic liquid;
- a sensor device comprising at least one sensor and an evaluation unit, wherein the sensor device is designed to independently detect whether the pump connection is connected to the rod-side passage or to the crown-side passage; and
- a control unit which is designed to control the apparatus in a rod-side operating mode when a rod-side pump connection is detected and to control the apparatus in a crown-side operating mode when a crown-side pump connection is detected, and
- wherein the sensor device is designed to:
- measure at least one characteristic variable, which is dependent on a pump connection side, of the drive piston, of the conveying piston, of the piston rod, of the hydraulic liquid and/or of the thick matter in detection operation of the drive pump, and
- detect a pump connection side based on the measured characteristic variable.

2. The apparatus according to claim 1, wherein
- two drive cylinders and two drive pistons are provided; and
- an oscillation connection is designed for a changeable connection of crown-side passages or rod-side passages of the two drive cylinders for a flow of the hydraulic liquid, such that the two drive pistons are coupled in terms of phase.

3. The apparatus according to claim 2, further comprising:
- an infeed and/or outfeed which is designed for infeed and/or outfeed of the hydraulic liquid into the oscillation connection side situated opposite the pump connection side,
- wherein the sensor device is designed to:
- measure a phase change of the drive piston, of the conveying piston and/or of the piston rod in the case of the infeed or the outfeed, and
- detect the pump connection side based on the measured phase change.

4. The apparatus according to claim 1, wherein the sensor device is further designed to:
- determine a comparison variable based on the drive volume flow or the drive pressure,
- compare the comparison variable with the at least one characteristic variable, and
- detect the pump connection side based on a comparison result.

5. The apparatus according to claim 1, wherein the sensor device has a position detection device and is designed to:
- detect two positions of the drive piston, of the conveying piston and/or of the piston rod, and
- detect the pump connection side based on the detection of the two positions of the drive piston, of the conveying piston and/or of the piston rod.

6. The apparatus according to claim 5, wherein the sensor device has a time measuring device and is designed to:
- measure a movement duration of the drive piston, of the conveying piston and/or of the piston rod between the two positions of the drive piston, of the conveying piston and/or of the piston rod, and
- detect the pump connection side based on the measured movement duration.

7. The apparatus according to claim 1, wherein the sensor device has a first pressure measuring device and is designed to:
- measure a pressure of the hydraulic liquid and/or of the thick matter, and
- detect the pump connection side based on the measured pressure of the hydraulic liquid and/or of the thick matter.

8. The apparatus according to claim 7, wherein the sensor device has a second pressure measuring device and is designed to:
- measure the drive pressure of the hydraulic liquid, and
- compare the measured drive pressure of the hydraulic liquid with the measured pressure of the hydraulic liquid and/or of the thick matter, and detect the pump connection side based on a comparison result.

9. An apparatus for conveying thick matter, comprising:

a drive cylinder for receiving hydraulic liquid;

a drive piston which is arranged in the drive cylinder;

a conveying cylinder for receiving the thick matter;

a conveying piston which is arranged in the conveying cylinder;

a piston rod which is fastened to the drive piston for motion coupling to the conveying piston, wherein the drive cylinder has a rod-side passage for pressurization of a rod side of the drive piston with the hydraulic liquid and has a crown-side passage for pressurization of a crown side, which is averted from the rod side, of the drive piston with the hydraulic liquid;

a drive pump which is designed to generate a drive volume flow, with a drive pressure, of the hydraulic liquid for the movement of the drive piston;

a pump connection which is designed for a changeable connection of the drive pump to the rod-side passage or to the crown-side passage for the flow of the hydraulic liquid;

a sensor device comprising at least one sensor and an evaluation unit, wherein the sensor device is designed to independently detect whether the pump connection is connected to the rod-side passage or to the crown-side passage; and a control unit which is designed to control the apparatus in a rod-side operating mode when a rod-side pump connection is detected and to control the apparatus in a crown-side operating mode when a crown-side pump connection is detected, and wherein at least one of:

(i) the pump connection and/or an oscillation connection have at least one identification element of the sensor device, and the rod-side passage and/or the crown-side passage have an identification detection device of the sensor device to detect the at least one identification element of the sensor device, or (ii) the rod-side passage and/or the crown-side passage have at least one identification element of the sensor device and the pump connection and/or the oscillation connection have at least one identification detection device of the sensor device to detect the at least one identification element of the sensor device;

wherein the sensor device is designed to detect a pump connection side based on the detection and/or non-detection of the at least one identification element of the sensor device.

* * * * *